US010856085B2

(12) United States Patent
Yu

(10) Patent No.: US 10,856,085 B2
(45) Date of Patent: Dec. 1, 2020

(54) MICROPHONE AND MANUFACTURE THEREOF

(71) Applicants: SEMICONDUCTOR MANUFACTURING INTERNATIONAL (SHANGHAI) CORPORATION, Shanghai (CN); SEMICONDUCTOR MANUFACTURING INTERNATIONAL (BEIJING) CORPORATION, Beijing (CN)

(72) Inventor: Hongjun Yu, Shanghai (CN)

(73) Assignees: SEMICONDUCTOR MANUFACTURING INTERNATIONAL (SHANGHAI) CORPORATION (CN); SEMICONDUCTOR MANUFACTURING INTERNATIONAL (BEIJING) CORPORATION (CN)

( * ) Notice: Subject to any disclaimer, the term of this patent is extended or adjusted under 35 U.S.C. 154(b) by 0 days.

(21) Appl. No.: 15/962,904

(22) Filed: Apr. 25, 2018

(65) Prior Publication Data

US 2018/0317018 A1 Nov. 1, 2018

(30) Foreign Application Priority Data

Apr. 26, 2017 (CN) ..... 2017 1 0279682

(51) Int. Cl.
*H04R 17/02* (2006.01)
*H04R 19/04* (2006.01)
(Continued)

(52) U.S. Cl.
CPC ..... *H04R 17/02* (2013.01); *H04R 19/04* (2013.01); *H04R 19/005* (2013.01); *H04R 31/00* (2013.01); *H04R 2201/003* (2013.01)

(58) Field of Classification Search
CPC ..... H04R 17/02; H04R 19/005; H04R 19/04; H04R 31/00; H04R 2201/003;
(Continued)

(56) References Cited

U.S. PATENT DOCUMENTS 5,452,268 A * 9/1995 Bernstein ..... H04R 19/005 367/181
8,803,257 B2 * 8/2014 Kasai ..... B81B 3/007 257/415
(Continued)

FOREIGN PATENT DOCUMENTS

CN 104113812 A 10/2014
KR 101711444 B1 3/2017

*Primary Examiner* — Fan S Tsang
*Assistant Examiner* — Angelica M McKinney
(74) *Attorney, Agent, or Firm* — Innovation Counsel LLP

(57) ABSTRACT

A microphone and its manufacturing method, relating to semiconductor techniques. The microphone comprises a substrate with a back through-hole going through the substrate; a first electrode layer on the substrate covering the back through-hole; a back plate on the substrate, wherein the back plate and the first electrode layer form a cavity, and the first electrode layer comprises a gap connecting the back through-hole and the cavity; and a second electrode layer in the cavity and on a bottom surface of the back plate. In this inventive concept, the gap in the first electrode layer increases the sensitivity of the first electrode layer and thus improves the Signal-to-Noise Ratio (SNR).

26 Claims, 7 Drawing Sheets

(51) Int. Cl.
*H04R 31/00* (2006.01)
*H04R 19/00* (2006.01)

(58) Field of Classification Search
CPC ..... B81C 1/00182; B81C 1/00904; B81C 1/00873; B81C 1/00896; B81C 1/00166
See application file for complete search history.

(56) References Cited

U.S. PATENT DOCUMENTS 9,980,052 B2 * 5/2018 Johansen ..... H04R 19/005
10,582,308 B2 * 3/2020 Yoo ..... B81B 3/0075
2007/0045757 A1 * 3/2007 Matsubara ..... H04R 19/005 257/416
2009/0045474 A1 * 2/2009 Nakatani ..... H04R 19/005 257/416
2009/0060232 A1 * 3/2009 Hirade ..... H04R 19/005 381/174
2009/0092273 A1 * 4/2009 Zhe ..... H04R 19/04 381/361
2009/0152655 A1 * 6/2009 Laming ..... G01L 9/0073 257/416
2010/0096714 A1 * 4/2010 Nakatani ..... B81C 1/00476 257/419
2010/0158279 A1 * 6/2010 Conti ..... H04R 7/24 381/174
2013/0221453 A1 * 8/2013 Dehe ..... H04R 19/005 257/415
2014/0314254 A1 * 10/2014 Conti ..... H04R 19/005 381/174
2015/0230027 A1 * 8/2015 Inoue ..... H04R 19/00 381/191
2015/0369653 A1 * 12/2015 Inoue ..... H04R 19/04 381/113
2016/0112807 A1 * 4/2016 Yuan ..... H04R 19/04 381/174
2017/0359648 A1 * 12/2017 Park ..... B81C 1/00015

* cited by examiner

MICROPHONE AND MANUFACTURE THEREOF

CROSS-REFERENCE TO RELATED APPLICATION

This application claims priority to and benefit of Chinese Patent Application No. 201710279682.8 filed on Apr. 26, 2017, which is incorporated herein by reference in its entirety.

BACKGROUND

(a) Field of the Invention

This inventive concept relates generally to semiconductor techniques, and more specifically, to a microphone and its manufacturing method.

(b) Description of the Related Art

Microphone is a sensor that converts sound energy into electricity signals, a capacitor-based Micro Electro Mechanical System (MEMS) microphone measures the capacitance fluctuation caused by sound-induced vibration on a vibration film, and converts it into an electric signal. Rapid developments in related techniques keep driving up the demands for MEMS microphones, especially those with high Signal-to-Noise Ratio (SNR).

Conventional microphones, however, have several limitations. First, the sensitivity of a bottom electrode layer in a conventional microphone, which typically works as its vibration film, can be further improved; second, an overlapped region between the bottom electrode layer and the substrate in a conventional microphone may generate noises and lower the SNR; and third, since the bottom electrode layer is separated from a back plate, a side surface of the bottom electrode layer may also generate noises and lower the SNR.

The inventor of this inventive concept investigated the issues in conventional methods and proposed an innovative solution that remedies at least some issues of the conventional methods.

SUMMARY

This inventive concept first presents a microphone, comprising:

a substrate with a back through-hole going through the substrate;

a first electrode layer on the substrate covering the back through-hole;

a back plate on the substrate, wherein the back plate and the first electrode layer form a cavity, and the first electrode layer comprises a gap connecting the back through-hole and the cavity; and a second electrode layer in the cavity and on a bottom surface of the back plate.

Additionally, in the aforementioned microphone, the first electrode layer may further comprise a vibration component on the back through-hole, with the gap on at least one side of the vibration component, and the first electrode layer may further comprise a plurality of gaps symmetrically distributed around the vibration component, the width of the gap may be in a range of 0.4 μm to 0.6 μm.

Additionally, in the aforementioned microphone, the first electrode layer may further comprise a fixture component around the vibration component and connecting to the vibration component, with the gap located between the fixture component and the vibration component.

Additionally, in the aforementioned microphone, the first electrode layer may further comprise a support component contacting the substrate, connecting to the fixture component, and surrounding the gap.

Additionally, in the aforementioned microphone, the first electrode layer may further comprise a protrusion on the vibration component protruding towards the substrate, with the plurality of gaps surrounding the protrusion.

Additionally, in the aforementioned microphone, the vibration component and the substrate may have an overlapped distance in a range of −0.3 μm to 0.3 μm.

Additionally, in the aforementioned microphone, an inner side surface of the back plate may directly contact a side surface of the first electrode layer.

Additionally, in the aforementioned microphone, the second electrode layer may comprise a plurality of first through-holes, and the back plate may comprise a plurality of second through-holes, wherein each second through-hole is aligned with a corresponding first through-hole, and the first through-holes and the second through-holes are both connected to the cavity.

This inventive concept further presents another microphone, comprising:

a substrate with a back through-hole going through the substrate;

a first electrode layer on the substrate covering the back through-hole;

a back plate on the substrate, wherein the back plate and the first electrode layer form a cavity, and an inner side surface of the back plate directly contacts a side surface of the first electrode layer; and a second electrode layer in the cavity and on a bottom surface of the back plate.

This inventive concept further presents a microphone manufacturing method, comprising:

providing a semiconductor structure comprising a substrate, a first sacrificial layer on the substrate, and a patterned first electrode layer on the first sacrificial layer, wherein the first electrode layer has a gap exposing a portion of the first sacrificial layer;

forming a second sacrificial layer on the first electrode layer;

forming a patterned second electrode layer on the second sacrificial layer;

forming a back plate on the substrate covering the second sacrificial layer and the second electrode layer;

forming a back through-hole in the substrate by etching a back side of the substrate, with the back through-hole exposing a portion of a bottom surface of the first sacrificial layer; and forming a cavity by removing a portion of the first sacrificial layer and the second sacrificial layer, with the gap connecting the back through-hole and the cavity.

Additionally, in the aforementioned method, the first electrode layer may further comprise a vibration component on the first sacrificial layer, with the gap at at least one side of the vibration component. The first electrode layer may further comprise a plurality of gaps symmetrically distributed around the vibration component, with the width of the gap in a range of 0.4 μm to 0.6 μm.

Additionally, in the aforementioned method, the first electrode layer may further comprise a fixture component around the vibration component and connecting to the vibration component, with the gap located between the fixture component and the vibration component. The first electrode layer may further comprise a support component contacting the substrate, connecting to the fixture component, and surrounding the gap, and a protrusion on the vibration component protruding towards the substrate, with the plurality of gaps surrounding the protrusion.

Additionally, in the aforementioned method, after the back through-hole has been formed, the vibration component and the substrate may have an overlapped distance in a range of −0.3 μm to 0.3 μm.

Additionally, in the aforementioned method, providing a semiconductor structure may comprise:

providing a substrate;

forming a first sacrificial layer on the substrate;

forming a first electrode layer on the first sacrificial layer; and forming a gap in the first electrode layer by patterning the first electrode layer.

Additionally, the aforementioned method may further comprise:

before forming the second electrode layer, etching the second sacrificial layer and the first sacrificial layer to expose a side surface of the first electrode layer, and when forming the back plate, an inner side surface of the back plate directly contacts the exposed side surface of the first electrode layer.

Additionally, in the aforementioned method, when etching the second sacrificial layer and the first sacrificial layer to expose a side surface of the first electrode layer, a portion of the substrate may also be exposed, and the back plate may be formed on the exposed portion of the substrate.

Additionally, in the aforementioned method, when forming a second electrode layer on the second sacrificial layer, a plurality of first through-holes exposing a portion of the second sacrificial layer may also be formed in the second electrode layer, and when forming a back plate on the substrate, a plurality of second through-holes may also be formed in the back plate, with each second through-hole aligned with a corresponding first through-hole, and the cavity may be formed by removing a portion of the first sacrificial layer and the second sacrificial layer through the back through-hole, the first through-holes, and the second through-holes.

This inventive concept further presents another microphone manufacturing method, comprising:

providing a semiconductor structure comprising a substrate, a first sacrificial layer on the substrate, and a patterned first electrode layer on the first sacrificial layer;

forming a second sacrificial layer on the first electrode layer;

etching the second sacrificial layer and the first sacrificial layer to expose a side surface of the first electrode layer;

forming a patterned second electrode layer on the second sacrificial layer;

forming a back plate on the substrate covering the second sacrificial layer and the second electrode layer, with an inner side surface of the back plate directly contacting a side surface of the first electrode layer;

forming a back through-hole by etching a back side of the substrate, with the back through-hole exposing a portion of a bottom surface of the first sacrificial layer; and forming a cavity by removing a portion of the first sacrificial layer and the second sacrificial layer.

Additionally, in the aforementioned method, when etching the second sacrificial layer and the first sacrificial layer to expose a side surface of the first electrode layer, a portion of the substrate may also be exposed, and the back plate may be formed on the exposed portion of the substrate. When forming a second sacrificial layer on the first electrode layer, a plurality of first through-holes exposing a portion of the second sacrificial layer may also be formed in the second electrode layer, and when forming a back plate on the substrate, a plurality of second through-holes may also be formed in the back plate, with each second through-hole aligned with a corresponding first through-hole, and the cavity may be formed by removing a portion of the first sacrificial layer and the second sacrificial layer through the back through-hole, the first through-holes, and the second through-holes.

BRIEF DESCRIPTION OF THE DRAWINGS

The accompanying drawings, which are incorporated herein and constitute a part of the specification, illustrate different embodiments of the inventive concept and, together with the detailed description, serve to describe more clearly the inventive concept.

DETAILED DESCRIPTION OF THE EMBODIMENTS

Figure 1:
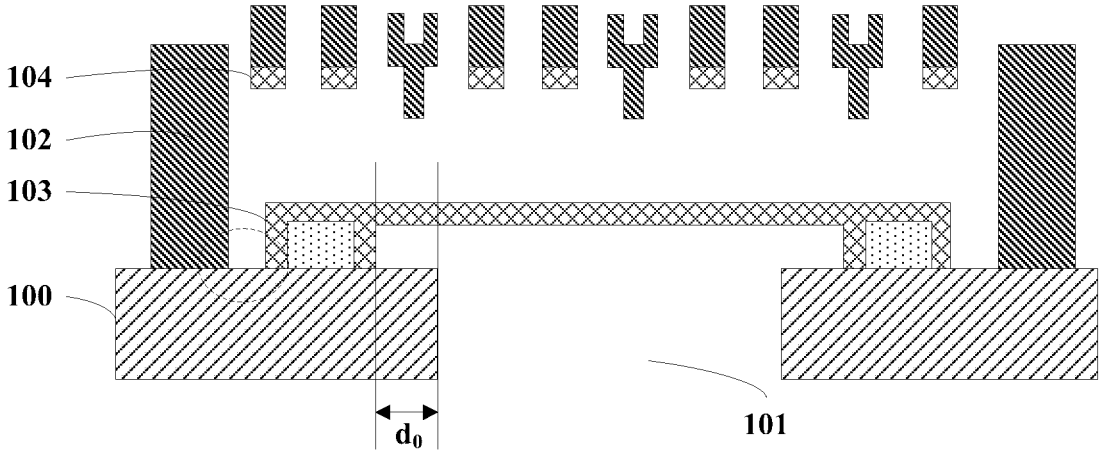
FIG. 1 shows a schematic sectional view illustrating a conventional microphone.

Example embodiments of the inventive concept are described with reference to the accompanying drawings. As those skilled in the art would realize, the described embodiments may be modified in various ways without departing from the spirit or scope of the inventive concept. Embodiments may be practiced without some or all of these specified details. Well known process steps and/or structures may not be described in detail, in the interest of clarity.

The drawings and descriptions are illustrative and not restrictive. Like reference numerals may designate like (e.g., analogous or identical) elements in the specification. To the extent possible, any repetitive description will be minimized.

Relative sizes and thicknesses of elements shown in the drawings are chosen to facilitate description and understanding, without limiting the inventive concept. In the drawings, the thicknesses of some layers, films, panels, regions, etc., may be exaggerated for clarity.

Embodiments in the figures may represent idealized illustrations. Variations from the shapes illustrated may be possible, for example due to manufacturing techniques and/or tolerances. Thus, the example embodiments shall not be construed as limited to the shapes or regions illustrated herein but are to include deviations in the shapes. For example, an etched region illustrated as a rectangle may have rounded or curved features. The shapes and regions illustrated in the figures are illustrative and shall not limit the scope of the embodiments.

Although the terms "first," "second," etc. may be used herein to describe various elements, these elements shall not be limited by these terms. These terms may be used to distinguish one element from another element. Thus, a first element discussed below may be termed a second element without departing from the teachings of the present inventive concept. The description of an element as a "first" element may not require or imply the presence of a second element or other elements. The terms "first," "second," etc. may also be used herein to differentiate different categories or sets of elements. For conciseness, the terms "first," "second," etc. may represent "first-category (or first-set)," "second-category (or second-set)," etc., respectively.

If a first element (such as a layer, film, region, or substrate) is referred to as being "on," "neighboring," "connected to," or "coupled with" a second element, then the first element can be directly on, directly neighboring, directly connected to or directly coupled with the second element, or an intervening element may also be present between the first element and the second element. If a first element is referred to as being "directly on," "directly neighboring," "directly connected to," or "directly coupled with" a second element, then no intended intervening element (except environmental elements such as air) may also be present between the first element and the second element.

Spatially relative terms, such as "beneath," "below," "lower," "above," "upper," and the like, may be used herein for ease of description to describe one element or feature's spatial relationship to another element(s) or feature(s) as illustrated in the figures. It will be understood that the spatially relative terms may encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientation), and the spatially relative descriptors used herein shall be interpreted accordingly.

The terminology used herein is for the purpose of describing particular embodiments and is not intended to limit the inventive concept. As used herein, singular forms, "a," "an," and "the" may indicate plural forms as well, unless the context clearly indicates otherwise. The terms "includes" and/or "including," when used in this specification, may specify the presence of stated features, integers, steps, operations, elements, and/or components, but may not preclude the presence or addition of one or more other features, integers, steps, operations, elements, components, and/or groups.

Unless otherwise defined, terms (including technical and scientific terms) used herein have the same meanings as what is commonly understood by one of ordinary skill in the art related to this field. Terms, such as those defined in commonly used dictionaries, shall be interpreted as having meanings that are consistent with their meanings in the context of the relevant art and shall not be interpreted in an idealized or overly formal sense unless expressly so defined herein.

The term "connect" may mean "electrically connect." The term "insulate" may mean "electrically insulate."

Unless explicitly described to the contrary, the word "comprise" and variations such as "comprises," "comprising," "include," or "including" may imply the inclusion of stated elements but not the exclusion of other elements.

Various embodiments, including methods and techniques, are described in this disclosure. Embodiments of the inventive concept may also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the inventive concept may also cover apparatuses for practicing embodiments of the inventive concept. Such apparatus may include circuits, dedicated and/or programmable, to carry out operations pertaining to embodiments of the inventive concept. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments of the inventive concept.

FIG. 1 shows a schematic sectional view illustrating a conventional microphone. In studying the SNR of a microphone, the inventor of this inventive concept discovered that the sensitivity of a bottom electrode layer 103 of a conventional microphone, which typically works as its vibration film, can be further improved. Additionally, in a conventional microphone, as shown in FIG. 1, the bottom electrode layer 103 and a substrate 100 have a large overlapped distance (for example, the overlapped distance $d_0$ in FIG. 1 may be larger than 1 μm) which, due to different acoustic characteristic at the edge (rather than the center) of the bottom electrode layer 103, causes a fluctuation on the capacitance and generates noises that lower the SNR. In this application, the SNR is calculated as: SNR=10 lg(Ps/Pn), where Ps is effective signal power, and Pn is effective noise power, so the SNR reflects a ratio between signal power and noise power, the higher the SNR, the lower the noise compared to the signal, the better the sound quality.

Additionally, referring to FIG. 1, in a conventional microphone, the bottom electrode layer 103 and a back plate 102 are spaced apart from each other (as circled in FIG. 1), hence a side surface of the bottom electrode layer 103 may also generate noises that lower the SNR. FIG. 1 also shows a back through-hole 101 and a top electrode layer 104 in a conventional microphone.

Figure 2:
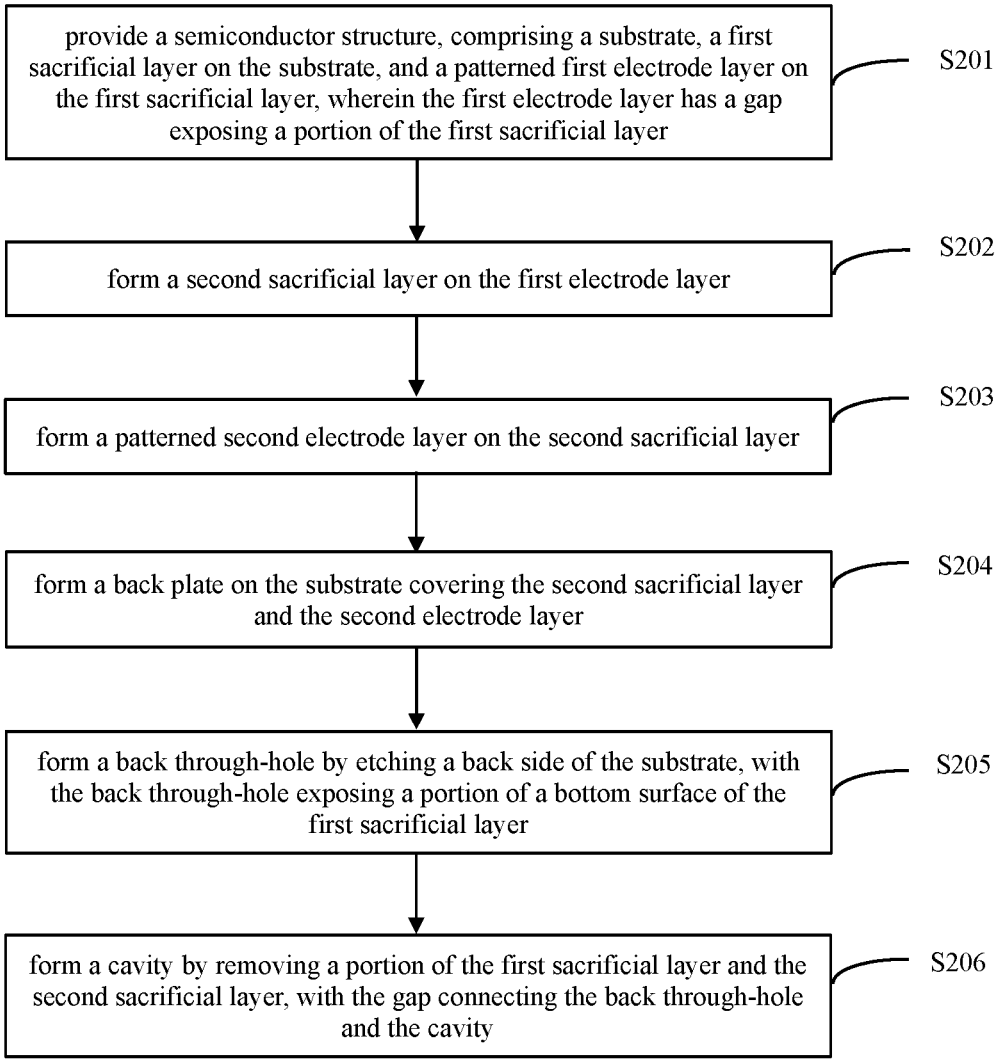
FIG. 2 shows a flowchart illustrating a microphone manufacturing method in accordance with one embodiment of this inventive concept.

FIG. 2 shows a flowchart illustrating a microphone manufacturing method in accordance with one embodiment of this inventive concept.

In step S201, a semiconductor structure is provided. The semiconductor structure comprises a substrate, a first sacrificial layer on the substrate, and a patterned first electrode layer on the first sacrificial layer, wherein the first electrode layer has a gap exposing a portion of the first sacrificial layer. For example, the width of the gap may be in a range of 0.4 μm to 0.6 μm (e.g., 0.5 μm).

In one embodiment, step S201 may comprise: providing a substrate; forming a first sacrificial layer on the substrate; forming a first electrode layer on the first sacrificial layer; and forming a gap in the first electrode layer by patterning the first electrode layer.

In step S202, a second sacrificial layer is formed on the first electrode layer.

In step S203, a patterned second electrode layer is formed on the second sacrificial layer. In one embodiment, in step S203, the second electrode layer may comprise a plurality of first through-holes exposing a portion of the second sacrificial layer.

In step S204, a back plate is formed on the substrate covering the second sacrificial layer and the second electrode layer. In one embodiment, in step S204, the back plate may comprise a plurality of second through-holes, with each second through-hole aligned with a corresponding first through-hole.

In step S205, a back through-hole is formed by etching a back side of the substrate, with the back through-hole exposing a portion of a bottom surface of the first sacrificial layer.

In step S206, a cavity is formed by removing a portion of the first sacrificial layer and the second sacrificial layer, wherein the gap connects the back through-hole and the cavity. For example, the cavity may be formed by removing a portion of the first sacrificial layer and the second sacrificial layer through the back through-hole, the first through-holes, and the second through-holes.

In the manufacturing method described above, a gap is formed in the first electrode layer that works as a bottom electrode layer. Compared to a solid electrode layer (e.g., the bottom electrode layer 103 in FIG. 1) in a conventional microphone, the gap in the first electrode layer increases the sensitivity of the first electrode layer and hence increases the SNR, it also helps to effectively remove the sacrificial layers.

In one embodiment, the first electrode layer may further comprise a vibration component on the first sacrificial layer, with the gap on at least one side of the vibration component. The first electrode layer may also comprise a plurality of gaps symmetrically distributed around the vibration component.

In one embodiment, the first electrode layer may further comprise a fixture component around the vibration component and connecting to the vibration component, with the gap located between the fixture component and the vibration component.

In one embodiment, the first electrode layer may further comprise a support component contacting the substrate, connecting to the fixture component, and surrounding the gap. In this embodiment, connecting the support component to the fixture component structurally strengthens the first electrode layer and lowers the damage rate in drop tests.

In one embodiment, the first electrode layer may further comprise a protrusion on the vibration component protruding towards the substrate, with the plurality of gaps surrounding the protrusion.

In one embodiment, after the back through-hole has been formed, the vibration component and the substrate may have an overlapped distance in a range of −0.3 μm to 0.3 μm. The overlapped distance may be 0 μm. Here, the overlapped distance of the vibration component and the substrate refers to a horizontal distance between the edge of the vibration component and the edge of the back through-hole in the substrate. A positive overlapped distance means the vibration component overlaps with the substrate, while a negative overlapped distance means the vibration component does not overlap with the substrate. In this embodiment, a small overlapped distance between the vibration component and the substrate means they have a small overlapped region, which lowers the noise and increases the SNR.

In one embodiment, the microphone manufacturing method may further comprise, before the second electrode layer is formed, etching the second sacrificial layer and the first sacrificial layer to expose a side surface of the first electrode layer. And when forming the back plate, an inner side surface of the back plate directly contacts the side surface of the first electrode layer. In this embodiment, since the inner side surface of the back plate direct contacts the side surface of the first electrode layer, noises generated from the side surface of the first electrode layer can be substantially reduced, which increases the SNR.

In one embodiment, when etching the second sacrificial layer and the first sacrificial layer to expose a side surface of the first electrode layer, a portion of the substrate is also exposed, and the back plate is formed on the exposed portion of the substrate.

Figure 3:
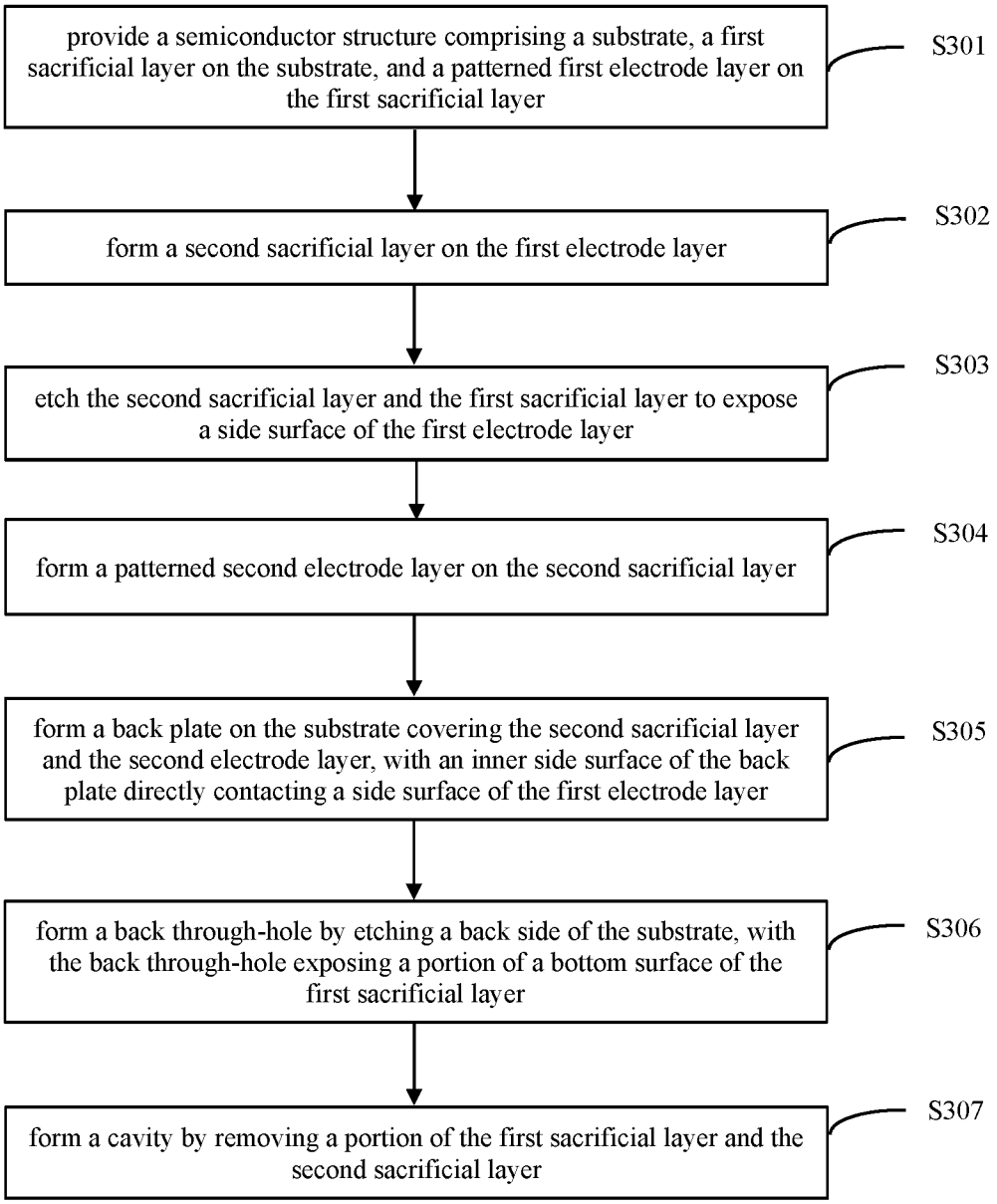
FIG. 3 shows a flowchart illustrating a microphone manufacturing method in accordance with another embodiment of this inventive concept.

FIG. 3 shows a flowchart illustrating a microphone manufacturing method in accordance with another embodiment of this inventive concept.

In step S301, a semiconductor structure is provided, the semiconductor structure comprises a substrate, a first sacrificial layer on the substrate, and a patterned first electrode layer on the first sacrificial layer.

In step S302, a second sacrificial layer is formed on the first electrode layer.

In step S303, the second sacrificial layer and the first sacrificial layer are etched to expose a side surface of the first electrode layer. In step S303, a portion of the substrate may also be exposed.

In step S304, a patterned second electrode layer is formed on the second sacrificial layer. In one embodiment, in step S304, the second electrode layer may comprise a plurality of first through-holes exposing a portion of the second sacrificial layer.

In step S305, a back plate is formed on the substrate covering the second sacrificial layer and the second electrode layer, with an inner side surface of the back plate directly contacting a side surface of the first electrode layer. For example, the back plate may be formed on the exposed portion of the substrate. In one embodiment, in step S305, the back plate may comprise a plurality of second through-holes, with each second through-hole aligned with a corresponding first through-hole.

In step S306, a back through-hole is formed by etching a back side of the substrate, with the back through-hole exposing a portion of a bottom surface of the first sacrificial layer.

In step S307, a cavity is formed by removing a portion of the first sacrificial layer and the second sacrificial layer. For example, the cavity may be formed by removing a portion of the first sacrificial layer and the second sacrificial layer through the back through-hole, the first through-holes, and the second through-holes.

In the manufacturing method described above, the inner side surface of the back plate directly contacts the side surface of the first electrode layer, which substantially reduces the noises generated from the side surface of the first electrode layer and increases the SNR.

FIGS. 4, 5, 6, 7, 8, 9, 10, 11, 12, and 13 show schematic sectional views illustrating different stages of a microphone manufacturing method in accordance with one or more embodiments of this inventive concept. FIG. 14 shows a top plan view of a first electrode layer in a microphone manufacturing method in accordance with one or more embodiments of this inventive concept. A microphone manufacturing method in accordance with one or more embodiments of this inventive concept is described below with reference to these drawings.

Figure 4:
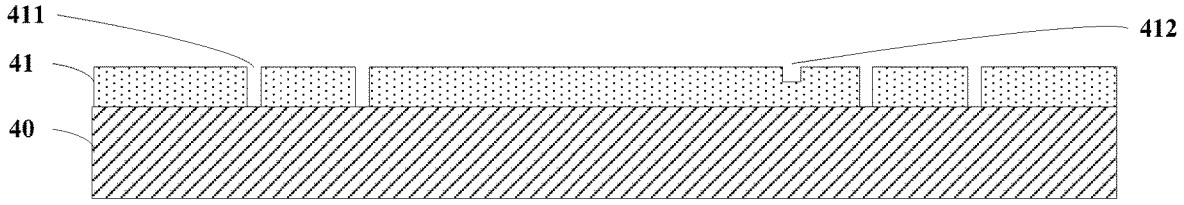
FIGS. 4, 5, 6, 7, 8, 9, 10, 11, 12, and 13 show schematic sectional views illustrating different stages of a microphone manufacturing method in accordance with one or more embodiments of this inventive concept.

First, referring to FIG. 4, a substrate 40 (which may be a silicon substrate) is provided, then a first sacrificial layer 41

(which may be made of silicon dioxide) may be deposited on the substrate 40. In one embodiment, a first opening 411 exposing a portion of the substrate 40 may be formed in the first sacrificial layer 41 by patterning the first sacrificial layer 41, the patterning process may also form on the first sacrificial layer 41 a first notch 412, which, however, does not expose the substrate 40.

Figure 5:
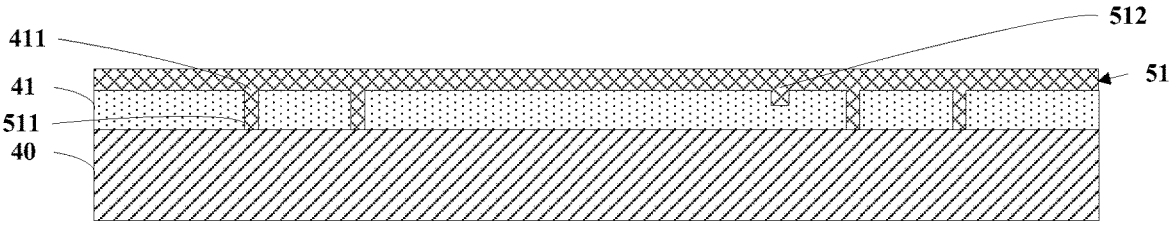

Next, referring to FIG. 5, a first electrode layer 51 (which may be made of polycrystalline silicon) may be deposited on the first sacrificial layer 41, with the first electrode layer 51 filling the first opening 411 and the first notch 412. The portion of the first electrode layer 51 filling the first opening 411 may work as a support component 511, and the portion of the first electrode layer 51 filling the first notch 412 may work as a protrusion 512.

Figure 6:
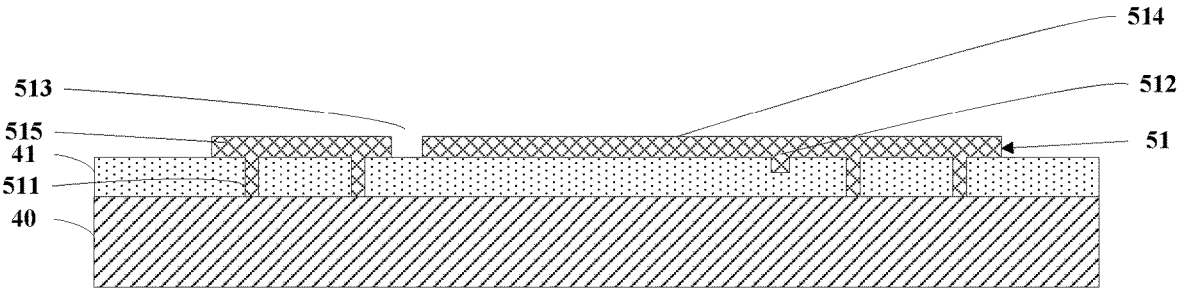

Next, referring to FIG. 6, a gap 513 may be formed in the first electrode layer 51 by patterning the first electrode layer 51. Optionally, the patterning of the first electrode layer 51 may also expose a portion of an upper surface of the first sacrificial layer 41 on two sides of the first electrode layer 51. After the patterning, the first electrode layer 51 may comprise a vibration component 514 on the first sacrificial layer 41, with the gap 513 at at least one side of the vibration component 514; a fixture component 515 around the vibration component 514 and connecting to the vibration component 514, with the gap 513 located between the fixture component 515 and the vibration component 514.

It should be understood that although FIG. 6 only shows one gap 513 located at one side of the vibration component 514, in some embodiments, the first electrode layer 51 may comprise a plurality of gaps 513 symmetrically distributed around the vibration component 514, one example is shown in FIG. 14.

FIG. 14 shows four gaps 513 symmetrically distributed around the vibration component 514. The fixture component 515 is located around the vibration component 514 and connected to the vibration component 514, and the gaps 513 are located between the fixture component 515 and the vibration component 514. The support component 511 is connected to the fixture component 515 and surrounds the gaps 513. The protrusion 512 is on the vibration component 514, with the gaps 513 surrounding the protrusion 512.

Figure 7:
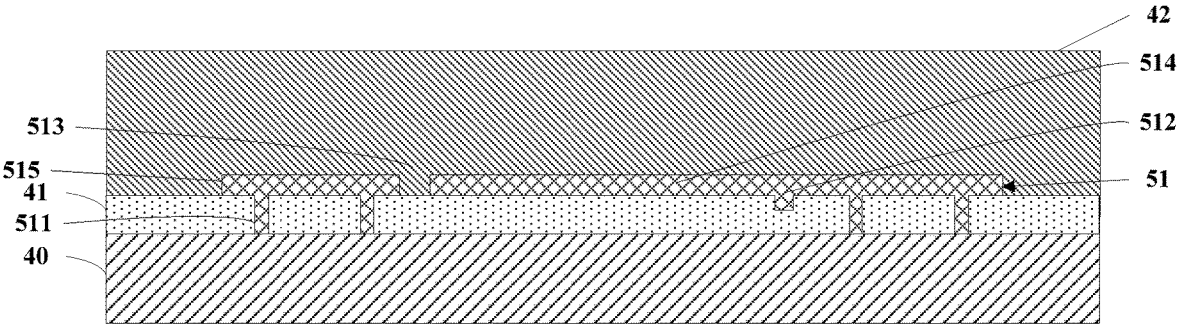

Next, referring to FIG. 7, a second sacrificial layer 42 (which may be made of silicon dioxide) may be deposited on the first electrode layer 51.

Figure 8:
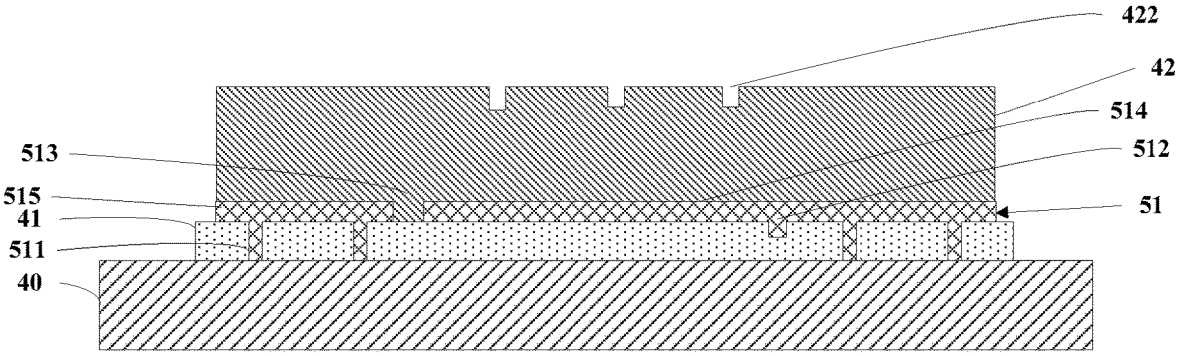

Next, referring to FIG. 8, the second sacrificial layer 42 and the first sacrificial layer 41 are etched to expose a side surface of the first electrode layer 51. The etching process may also expose a portion of the substrate 40. Optionally, a second notch 422 may be formed on the second sacrificial layer 42 by etching the second sacrificial layer 42.

Figure 9:
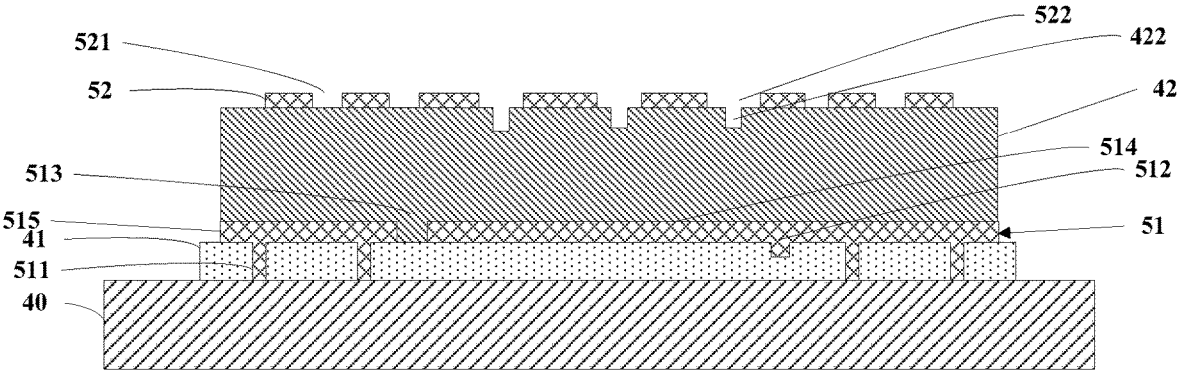

Next, referring to FIG. 9, a patterned second electrode layer 52 (which may be made of polycrystalline silicon) may be formed on the second sacrificial layer 42. For example, the second electrode layer 52 may first be formed on the second sacrificial layer 42 through a deposition process, then the second electrode layer 52 is patterned through an etching process to form a plurality of first through-holes 521 exposing a portion of the second sacrificial layer 42. Optionally, the patterning process may also form a plurality of second openings 522 exposing the second notch 422.

Figure 10:
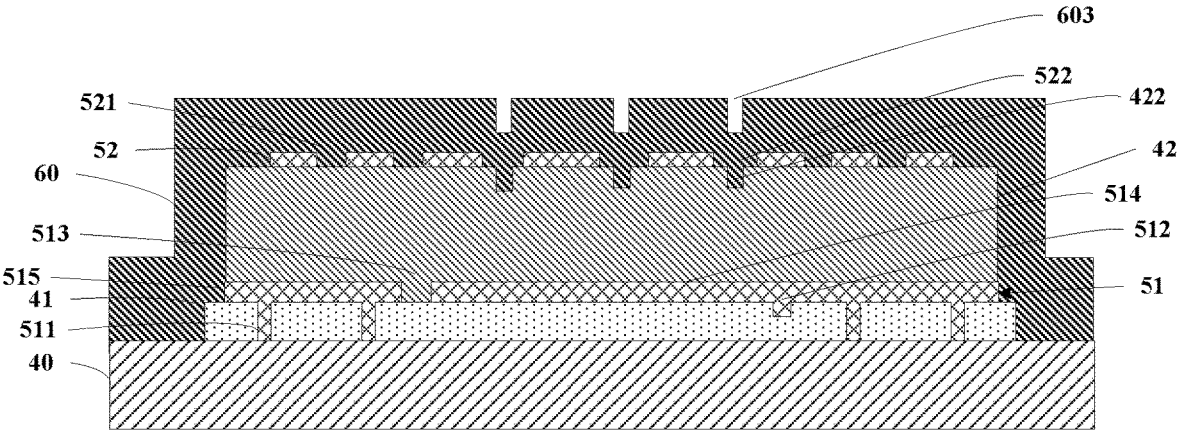

Next, referring to FIG. 10, a back plate 60 (which may be made of silicon nitride) may be deposited on the exposed portion of the substrate 40 covering the second sacrificial layer 42 and the second electrode layer 52. An inner side surface of the back plate 60 directly contacts a side surface of the first electrode layer 51. Optionally, when forming the back plate 60, the back plate 60 may comprise a plurality of third notches 603, with each third notch 603 aligned with a corresponding second notch 422.

Figure 11:
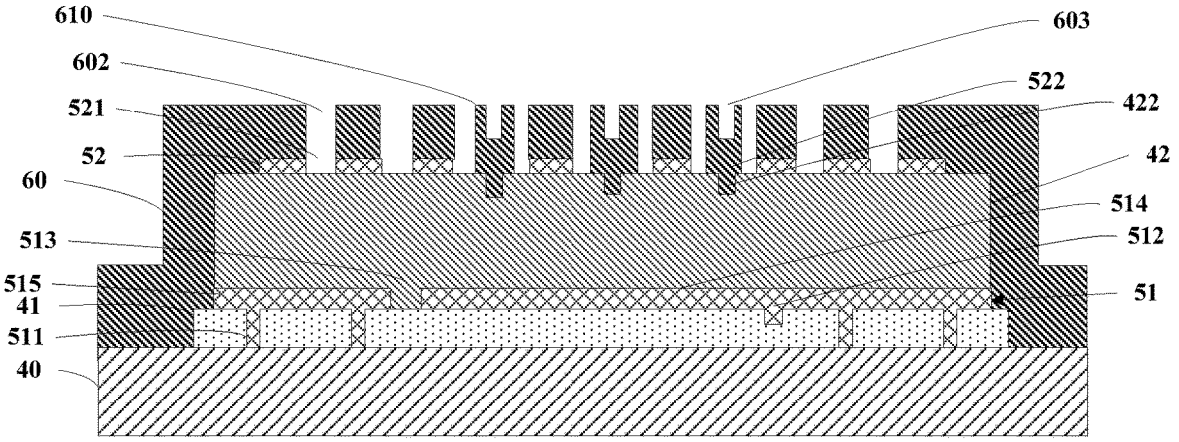

Next, referring to FIG. 11, a plurality of second through-holes 602 are formed in the back plate 60 by etching the back plate 60, with each second through-hole 602 aligned with a corresponding first through-hole 521. Optionally, when etching the back plate 60, a plurality of block components 610 may also be formed in the back plate 60, the bottom of the block components 610 extends below the second electrode layer 52 to prevent the second electrode layer 52 from adhering with the first electrode layer 51 when vibrating.

Figure 12:
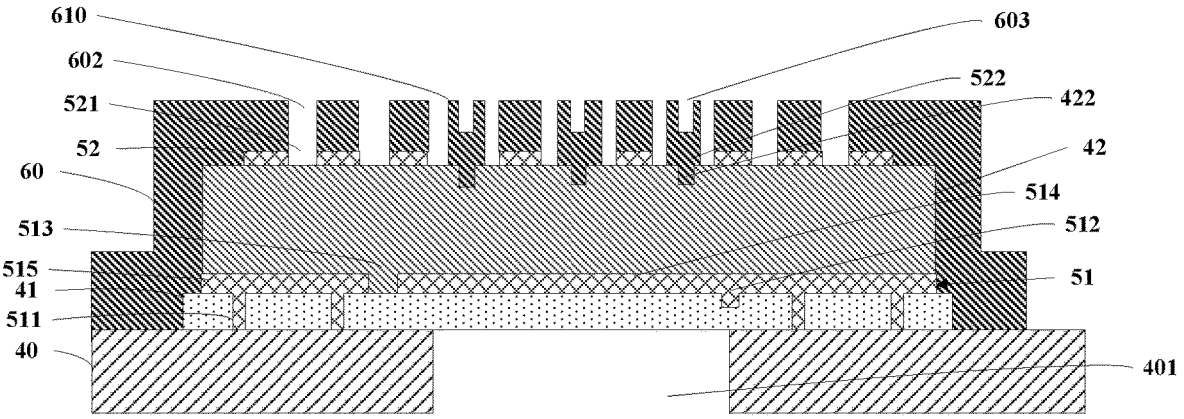

Next, referring to FIG. 12, a back through-hole 401 is formed in the substrate 40 by etching a back side of the substrate 40, the back through-hole 401 may expose a portion of a bottom surface of the first sacrificial layer 41.

Figure 13:
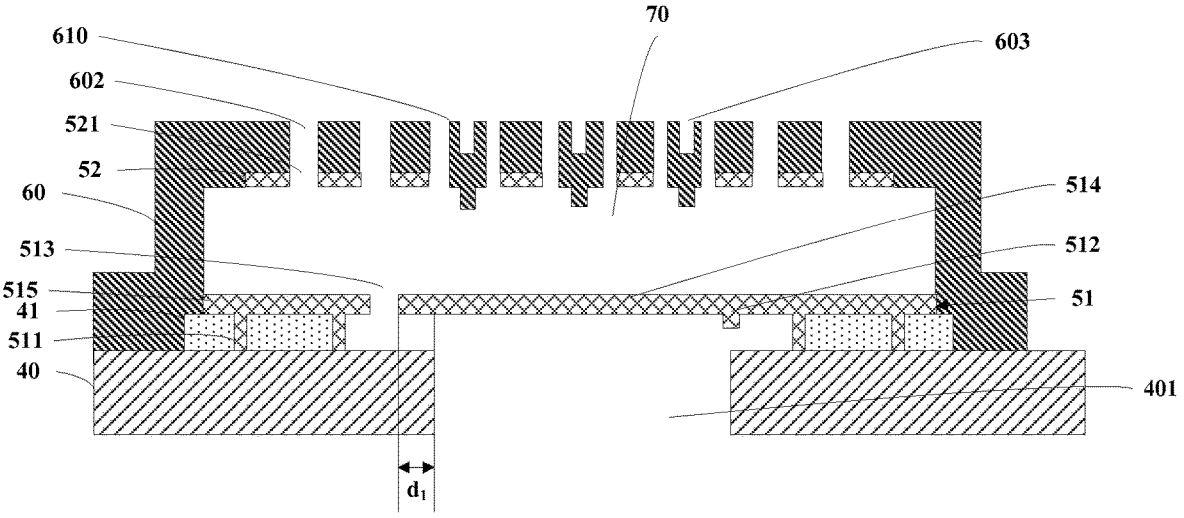
Figure 14:
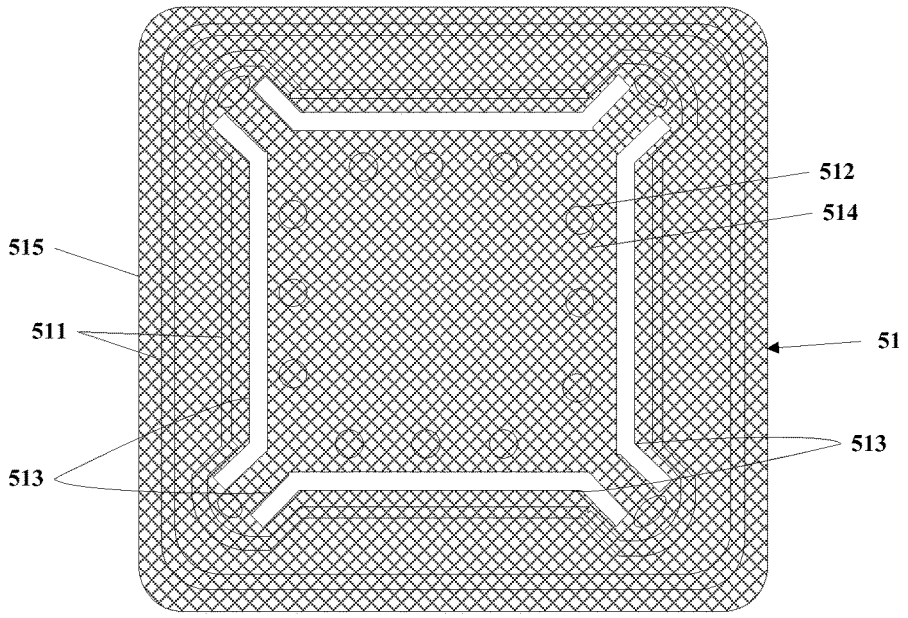
FIG. 14 shows a top plan view of a first electrode layer in a microphone manufacturing method in accordance with one or more embodiments of this inventive concept.

Next, referring to FIG. 13, a cavity 70 is formed by using a wet etching process to remove a portion of the first sacrificial layer 41 and the second sacrificial layer 42 through the back through-hole 401, the first through-holes 521, and the second through-holes 602. The back plate 60 and the first electrode layer 51 enclose the cavity 70, with the second electrode layer 52 in the cavity 70. The gap 513 connects the back through-hole 401 and the cavity 70.

This concludes the description of a microphone manufacturing method in accordance with one or more embodiments of this inventive concept. In this manufacturing method, the gap in the first electrode layer increases the sensitivity of the first electrode layer and hence increases the SNR, it also helps to effectively remove the first sacrificial layer and/or the second sacrificial layer.

Additionally, in this manufacturing method, the vibration component and the substrate have a small overlapped distance, which further reduces the noises and increases the SNR. The inner side surface of the back plate directly contacts the side surface of the first electrode layer, which reduces the noises generated from the side surface of the first electrode layer and increases the SNR. This manufacturing method requires few additional procedures to the conventional manufacturing methods and therefore can be easily integrated into existing manufacturing methods.

Figure 15:
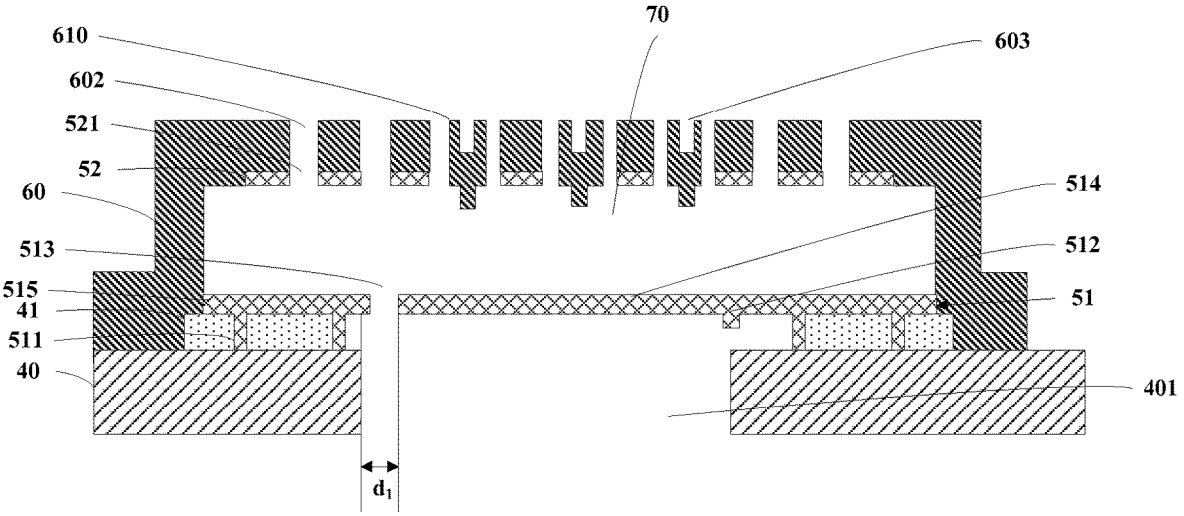
FIG. 15 shows a schematic sectional view illustrating one stage of a microphone manufacturing method in accordance with one or more embodiments of this inventive concept, in which a first electrode layer and a substrate have a negative overlapped distance.

This inventive concept further presents a microphone, which is described below with reference to FIGS. 13, 14, and 15.

Referring to FIG. 13, the microphone may comprises a substrate 40 that has a back through-hole 401 going through the substrate 40, a first electrode layer 51 on the substrate 40 covering the back through-hole 401, a back plate 60 on the substrate 40, wherein the back plate 60 and the first electrode layer 51 form a cavity 70. The first electrode layer 51 may comprise a gap 513 connecting the back through-hole 401 and the cavity 70. The microphone may further comprise a second electrode layer 52 in the cavity 70 and on a bottom surface of the back plate 60. In this embodiment, the gap in the first electrode layer increases the sensitivity of the first electrode layer, and thus increases the SNR, it also helps to effectively remove the first sacrificial layer and/or the second sacrificial layer.

Referring to FIG. 13, in one embodiment, the first electrode layer 51 may further comprise a vibration component 514 on the back through-hole 401, with the gap 513 at at least one side of the vibration component 514. Referring to FIG. 14, the first electrode layer 51 may comprise a plurality of gaps 513 symmetrically distributed around the vibration component 514.

In one embodiment, the width of the gap 513 may be in a range of 0.4 μm to 0.6 μm (e.g., 0.5 μm).

In one embodiment, the first electrode layer 51 may further comprise a fixture component 515 around the vibration component 514 and connecting to the vibration component 514, with the gap 513 located between the vibration component 514 and the fixture component 515.

In one embodiment, referring to FIGS. 13 and 14, the first electrode layer 51 may further comprise a support component 511 contacting the substrate 40, connecting to the fixture component 515, and surrounding the gap 513. In this embodiment, connecting the support component 511 to the fixture component 515 structurally strengthens the first electrode layer 51 and lowers the damage rate in drop tests.

In one embodiment, referring to FIG. 14, the first electrode layer 51 may further comprise a protrusion 512 on the vibration component 514 and protruding towards the substrate 40, with the plurality of gaps 513 surrounding the protrusion 512. The protrusion 512 prevents the first electrode layer 51 from hitting the edge of the back through-hole 401 when vibrating.

In one embodiment, the vibration component 514 and the substrate 40 have an overlapped distance in a range of −0.3 μm to 0.3 μm. Optionally, the overlapped distance may be 0 μm. As mentioned before, the overlapped distance between the vibration component 514 and the substrate 40 refers to a horizontal distance between the edge of the vibration component 514 and the edge of the back through-hole 401, as shown in FIGS. 13 and 15. A positive overlapped distance (e.g., "d1" in FIG. 13) means the vibration component 514 and the substrate 40 overlap, and a negative overlapped distance (e.g., "d1" in FIG. 15) means the vibration component 514 and the substrate 40 do not overlap. In this embodiment, a small overlapped distance between the vibration component 514 and the substrate 40 means they have a small overlapped region, which helps to lower the noises and increase the SNR.

Referring to FIG. 13, an inner side surface of the back plate 60 may directly contact a side surface of the first electrode layer 51, which reduces the noises generated from the side surface of the first electrode layer 51 and increases the SNR.

Referring to FIG. 13, in one embodiment, the second electrode layer 52 may comprise a plurality of first through-holes 521, the back plate 60 may comprise a plurality of second through-holes 602, with each second through-hole 602 aligned with a corresponding first through-hole 521, and the first through-hole 521 and the second through-hole 602 both connected to the cavity 70.

Referring to FIG. 13, in one embodiment, the back plate 60 may comprise a plurality of block components 610, the bottom of the block component 610 extends below the second electrode layer 52, and thus prevents the second electrode layer 52 from adhering with the first electrode layer 51 when vibrating. Optionally, the block component 610 may comprise a third notch 603.

Referring to FIG. 13, in one embodiment, the microphone may further comprise a first sacrificial layer 41 on the substrate 40, with at least a portion of the first sacrificial layer 41 located between the first electrode layer 51 and neighboring support components 511, and at least a portion of the first sacrificial layer 41 located between the support component 511 and the back plate 60.

This inventive concept further includes another embodiment of a microphone. Referring to FIG. 13, the microphone comprises a substrate 40 that has a back through-hole 401 going through the substrate 40; and a first electrode layer 51 on the substrate 40 covering the back through-hole 401. This microphone may further comprise a back plate 60 on the substrate 40, wherein the back plate 60 and the first electrode layer 51 form a cavity 70, and an inner side surface of the back plate 60 directly contacts a side surface of the first electrode layer 51. This microphone may further comprise a second electrode layer 52 in the cavity 70 and on a bottom surface of the back plate 60. In this embodiment, since the inner side surface of the back plate 60 directly contacts the side surface of the first electrode layer 51, the noises generated from the side surface of the first electrode layer 51 can be substantially reduced, resulting in increased SNR.

This concludes the description of a microphone and its manufacturing method in accordance with one or more embodiments of this inventive concept. For purposes of conciseness and convenience, explicit and detailed descriptions of components or procedures that are well known to one of ordinary skills in the art in this field are omitted.

While this inventive concept has been described in terms of several embodiments, there are alterations, permutations, and equivalents, which fall within the scope of this disclosure. It shall also be noted that there are alternative ways of implementing the methods and/or apparatuses of the inventive concept. Furthermore, embodiments may find utility in other applications. It is therefore intended that the claims be interpreted as including all such alterations, permutations, and equivalents. The abstract section is provided herein for convenience and, due to word count limitation, is accordingly written for reading convenience and shall not be employed to limit the scope of the claims.

What is claimed is:

1. A microphone, comprising:

a substrate with a back through-hole going through the substrate;

a first electrode layer overlapping a face of the substrate, covering the back through-hole, and comprising a support component, a protrusion, and a gap, wherein the support component is electrically conductive and directly contacts the substrate, wherein the protrusion protrudes toward the substrate, is spaced from the substrate, and is electrically connected to the support component, and wherein the gap is positioned between the support component and the protrusion;

a back plate on the substrate, wherein the back plate and the first electrode layer form a cavity, and wherein the gap connects the back through-hole and the cavity; and a second electrode layer in the cavity and on a bottom surface of the back plate.

2. The microphone of claim 1, wherein the first electrode layer further comprises a vibration component on the back through-hole, with the gap on at least one side of the vibration component.

3. The microphone of claim 2, wherein the first electrode layer comprises a plurality of gaps symmetrically distributed around the vibration component.

4. The microphone of claim 3, wherein an edge of the back through-hole is positioned between two edges of the protrusion in a direction parallel to the face of the substrate, and wherein one of the two edges of the protrusion is positioned between the edge of the back through-hole and a center of the back through-hole in the direction parallel to the face of the substrate and is positioned closer to the edge of the back through-hole than to the center of the back through-hole in the direction parallel to the face of the substrate, and wherein the protrusion is positioned on the vibration component, with the plurality of gaps surrounding the protrusion.

5. The microphone of claim 2, wherein the first electrode layer further comprises a fixture component around the vibration component and connecting to the vibration component, with the gap located between the fixture component and the vibration component.

6. The microphone of claim 5, wherein the support component is directly connected to the fixture component and surrounds the gap.

7. The microphone of claim 2, wherein the vibration component and the substrate have an overlapped distance in a range of −0.3 μm to 0.3 μm.

8. The microphone of claim 1, wherein the width of the gap is in a range of 0.4 μm to 0.6 μm.

9. The microphone of claim 1, wherein an inner side surface of the back plate directly contacts a side surface of the first electrode layer.

10. The microphone of claim 1, wherein the second electrode layer comprises a plurality of first through-holes, and the back plate comprises a plurality of second through-holes, wherein each second through-hole is aligned with a corresponding first through-hole, and the first through-holes and the second through-holes are both connected to the cavity.

11. A microphone, comprising:

a substrate with a back through-hole going through the substrate;

a first electrode layer positioned on the substrate, covering the back through-hole, and comprising a support component, wherein the support component is electrically conductive, protrudes from an electrically conductive face of the first electrode toward the substrate, and directly contacts a semiconductor surface of the substrate;

a back plate directly contacting each of the first electrode and the semiconductor surface of the substrate, wherein the back plate and the first electrode layer form a cavity; and a second electrode layer in the cavity and on a bottom surface of the back plate.

12. A microphone manufacturing method, comprising:

providing a semiconductor structure comprising a substrate, a first sacrificial layer on the substrate, and a first electrode layer on the first sacrificial layer, wherein the first electrode layer has a gap exposing a first portion of the first sacrificial layer, and wherein two sides of a second portion of the first sacrificial layer respectively directly contact two electrically conductive sides of the first electrode layer;

forming a second sacrificial layer on the first electrode layer;

forming a second electrode layer on the second sacrificial layer;

forming a back plate on the substrate covering the second sacrificial layer and the second electrode layer, wherein a material of the back plate is different from a material of the first sacrificial layer;

forming a back through-hole in the substrate by etching a back side of the substrate, with the back through-hole exposing a portion of a bottom surface of the first sacrificial layer; and forming a cavity by removing the first portion of the first sacrificial layer and the second sacrificial layer, with the gap connecting the back through-hole and the cavity, wherein the second portion of the first sacrificial layer is retained after the first portion of the first sacrificial layer has been removed.

13. The method of claim 12, wherein the first electrode layer further comprises a vibration component on the first sacrificial layer, with the gap at at least one side of the vibration component.

14. The method of claim 13, wherein the first electrode layer further comprises a plurality of gaps symmetrically distributed around the vibration component.

15. The method of claim 14, wherein the first electrode layer further comprises a protrusion on the vibration component protruding towards the substrate, with the plurality of gaps surrounding the protrusion.

16. The method of claim 13, wherein the first electrode layer further comprises a fixture component around the vibration component and connecting to the vibration component, with the gap located between the fixture component and the vibration component.

17. The method of claim 16, wherein the first electrode layer further comprises a support component contacting the substrate, connecting to the fixture component, and surrounding the gap.

18. The method of claim 13, wherein after the back through-hole has been formed, the vibration component and the substrate have an overlapped distance in a range of −0.3 μm to 0.3 μm.

19. The method of claim 12, wherein the width of the gap is in a range of 0.4 μm to 0.6 μm.

20. The method of claim 12, wherein providing a semiconductor structure comprises:

providing the substrate;

forming the first sacrificial layer on the substrate;

forming the first electrode layer on the first sacrificial layer; and forming the gap in the first electrode layer by patterning the first electrode layer.

21. The method of claim 12, further comprising:

before forming the second electrode layer, etching the second sacrificial layer and the first sacrificial layer to expose a side surface of the first electrode layer, and wherein when forming the back plate, an inner side surface of the back plate directly contacts the exposed side surface of the first electrode layer.

22. The method of claim 21, wherein when etching the second sacrificial layer and the first sacrificial layer to expose the side surface of the first electrode layer, a portion of the substrate is also exposed, and the back plate is formed on the exposed portion of the substrate.

23. The method of claim 12, wherein when forming the second electrode layer on the second sacrificial layer, a plurality of first through-holes exposing a portion of the second sacrificial layer are also formed in the second electrode layer, and when forming the back plate on the substrate, a plurality of second through-holes are also formed in the back plate, with each second through-hole aligned with a corresponding first through-hole, and the cavity is formed by removing a portion of the first sacrificial layer and the second sacrificial layer through the back through-hole, the first through-holes, and the second through-holes.

24. A microphone manufacturing method, comprising:

providing a semiconductor structure comprising a substrate, a first sacrificial layer on the substrate, and a first electrode layer on the first sacrificial layer;

forming a second sacrificial layer on the first electrode layer;

etching the second sacrificial layer and the first sacrificial layer to expose a side surface of the first electrode layer;

forming a second electrode layer on the second sacrificial layer;

forming a back plate on the substrate covering the second sacrificial layer and the second electrode layer, with an inner side surface of the back plate directly contacting the side surface of the first electrode layer, wherein the side surface of the first electrode layer is not parallel to a first face of the substrate, and wherein an outer side surface of the back plate is not parallel to the first face of the substrate and is positioned between the side surface of the first electrode layer and a second face of the substrate in a direction parallel to the first face of the substrate;

forming a back through-hole by etching a back side of the substrate, with the back through-hole exposing a portion of a bottom surface of the first sacrificial layer; and forming a cavity by removing a portion of the first sacrificial layer and the second sacrificial layer.

25. The method of claim 24, wherein when etching the second sacrificial layer and the first sacrificial layer to expose the side surface of the first electrode layer, a portion of the substrate is also exposed, and the back plate is formed on the exposed portion of the substrate.

26. The method of claim 24, wherein when forming the second sacrificial layer on the first electrode layer, a plurality of first through-holes exposing a portion of the second sacrificial layer are also formed in the second electrode layer, and when forming the back plate on the substrate, a plurality of second through-holes are also formed in the back plate, with each second through-hole aligned with a corresponding first through-hole, and the cavity is formed by removing a portion of the first sacrificial layer and the second sacrificial layer through the back through-hole, the first through-holes, and the second through-holes.

* * * * *